US008313208B2

(12) United States Patent
Tyson et al.

(10) Patent No.: US 8,313,208 B2
(45) Date of Patent: Nov. 20, 2012

(54) IN-GRADE LIGHTING SYSTEM

(75) Inventors: Glenn M. Tyson, La Crescenta, CA (US); Richard M. Schuler, Long Beach, CA (US); Michael P. Leonhardt, Castaic, CA (US)

(73) Assignee: ABL IP Holding LLC, Conyers, GA (US)

( * ) Notice: Subject to any disclaimer, the term of this patent is extended or adjusted under 35 U.S.C. 154(b) by 123 days.

(21) Appl. No.: 12/892,063

(22) Filed: Sep. 28, 2010

(65) Prior Publication Data

US 2011/0032709 A1 Feb. 10, 2011

Related U.S. Application Data

(63) Continuation of application No. 11/945,414, filed on Nov. 27, 2007, now Pat. No. 7,806,550.

(51) Int. Cl.
*E01F 9/00* (2006.01)

(52) U.S. Cl. ..... 362/153.1; 362/153; 362/373

(58) Field of Classification Search ..... 362/153, 362/153.1, 364–366, 373–375, 158, 645, 362/267, 455, 418, 427, 429, 436
See application file for complete search history.

(56) References Cited

U.S. PATENT DOCUMENTS

| | | | | |
|---|---|---|---|---|
| 4,343,033 | A | 8/1982 | Suzuki | 362/307 |
| 4,539,629 | A | 9/1985 | Poppenheimer | 362/267 |
| 4,729,076 | A * | 3/1988 | Masami et al. | 362/235 |
| 4,947,307 | A * | 8/1990 | Quiogue | 362/325 |
| 5,198,962 | A | 3/1993 | Tyson | 361/679 |
| 5,276,583 | A | 1/1994 | Tyson | 361/679 |
| RE34,709 | E | 8/1994 | Tyson | 362/96 |
| 5,408,397 | A | 4/1995 | Tyson | 362/267 |
| 5,486,988 | A | 1/1996 | Tyson | 362/267 |
| 5,727,873 | A | 3/1998 | Tyson | 362/294 |
| 5,887,966 | A | 3/1999 | Eissner et al. | 362/153.1 |
| 5,908,236 | A | 6/1999 | Lueken et al. | 362/364 |
| 6,068,384 | A | 5/2000 | Tyson et al. | 362/153.1 |
| 6,853,151 | B2 | 2/2005 | Leong et al. | 315/185 |
| 7,175,297 | B2 | 2/2007 | Hagen | 362/153.1 |
| 2006/0198129 | A1 | 9/2006 | Hagen | 362/153.1 |
| 2006/0262542 | A1 * | 11/2006 | Ibbitson et al. | 362/368 |

* cited by examiner

*Primary Examiner* — William Carter
(74) *Attorney, Agent, or Firm* — Connolly Bove Lodge & Hutz LLP

(57) ABSTRACT

A lighting system has a sealable housing with a lamp cavity, a junction box and a partition wall there between with the junction box being laterally from beneath a lens opening. The system further includes a closure to close an access port in the partition wall which includes a conical wall with a circular plate truncating the wall. The plate extends across the bottom of the housing and a vertically extending sealing flange receives the closure. A ballast assembly is also located from beneath the lens opening. A formed seal is positioned about a lens which extends inwardly to capture optic components beneath the lens. A locking ring is restrained from compressing against the mounting flange of the lens. A lighting system employing an LED board array and LED power control includes a heat sink beneath the board array extending downwardly to a radiator for transfer of heat from the array downwardly to the lamp cavity for dissipation.

4 Claims, 8 Drawing Sheets

IN-GRADE LIGHTING SYSTEM

CROSS-REFERENCE TO RELATED APPLICATIONS

This is a continuation of U.S. patent application Ser. No. 11/945,414, filed Nov. 27, 2007, now U.S. Pat. No. 7,806,550, issued Oct. 5, 2010, the disclosure of which is incorporated herein by reference.

BACKGROUND OF THE INVENTION

The field of the present invention is in-grade lighting systems.

In-grade lighting systems have an infinite number of applications for both indoor and outdoor illumination. Among long-term design issues of concern here, lamp profile for flexible application, maintenance with continued integrity and cooling are addressed.

For indoor applications, in-grade lighting is often utilized to provide general illumination or accent illumination to interior walls and objects in public spaces where the use of surface mounted or exposed fixtures are subjected to vandalism, or where the placement of available electrical service requires its use.

In outdoor applications, such lighting systems can be used to illuminate and thus enhance the effects of a variety of objects such as flag poles, signs, shrubbery, and other architectural points of interest. Outdoor lighting can also provide general flood lighting to areas for security purposes and spot-lighting where desired.

In-grade lighting systems are also used in semi-indoor areas such as parking structures to separate vehicular traffic flow from pedestrian traffic, or in transitional spaces such as the parapets of buildings to illuminate architectural elements which require the lighting sources to be hidden completely from view.

As lighting systems in outdoor applications are subject to a wide variety of conditions, particular attention must be directed to long-term survival. Thermal cycling, moisture, corrosive soils, vehicle and foot traffic, periodic maintenance and the like are particularly problematic for in-grade lighting applications. Further, in-grade lighting is found in hardscape applications which make removal and replacement of in-grade fixtures highly undesirable.

For indoor lighting system applications, the depth of the fixture creates challenges in placing them in areas with limited space between floor and ceiling structures. Generally, eight inches has been determined to be the maximum depth acceptable in such multi-story structures, limiting the variety of lamp types available. The general practice of installing electrical supply wiring after fixture housing installation requires direct access to the junction box. With limited depth requirements, junction boxes traditionally have been small and difficult to seal. Electrical supply wiring is solid wire, making its manipulation into a small junction box after fixture splicing difficult. Routing of the spliced wires out of the junction box to the lamp and ballast assemblies within the fixture is further complicated with the limited space.

In-grade lighting can have the problem of accumulating dirt and debris about the lens. Opening the lighting system for maintenance, such as relamping, can allow that material to become lodged further into the fixture. This can interfere with clearance, fit and sealing. Such changes can later result in spontaneous failure or failure under repeated vehicle or pedestrian loading on the lens. Such problems can be further aggravated by the size of the opening required to accommodate a given size lens sight glass. The greater the overall diameter of the lamp at grade, the greater the exposure and force interactions with the fixture.

The foregoing applications and environmental challenges have long been recognized with various design efforts undertaken to satisfactorily meet such challenges. U.S. Reissue Pat. No. 34,709, and U.S. Pat. Nos. 5,198,962; 5,276,583; 5,408,397; 5,486,988; 5,727,873; 6,068,384; all incorporated herein by reference, describe lighting systems and construction that address the challenges of in-grade lighting design. The construction includes improved sealing mechanisms for lighting assemblies, non corroding materials and rugged structures providing improved and reliable indoor and outdoor lighting features.

The heat generated by in-grade lighting systems are of particular concern in the design of indoor applications due to the increased risk of direct contact by the persons occupying the space. This again limits the lamp type availability. These design challenges, particularly in the setting of a sealable lamp housing, are interrelated with changes made to accommodate one challenge often adversely impacting other challenges. Reducing lamp profile adversely impacts variety of lamp offerings, access for relamping and increases heat load. Maintenance, particularly as affecting continued sealing integrity, is adversely impacted by reduction in lamp housing space such as would accompanying reduction in the lamp profile. Cooling needs traditionally are contrary to small housings and are adversely impacted by sealing of the housing which impacts convection. Reduced lamp profile also can adversely impact long demanded features such as the ability to aim the light independently of the housing. Further, where profile is an issue in in-grade applications, flow through cooling which necessarily allows water entry as well, is often inappropriate.

Of long-term concern to those engaged in the design of in-grade lighting fixtures is the provision of lamps for applications in-grade where a highly permanent installation requires long-term reliability, e.g., an in-grade application embedded in a concrete drive or flooring. The longevity of architectural features are typically measured in decades. During that time, even the most reliable fixture will require maintenance to replace the light source. Such maintenance can require lamp replacements, ballast assembly replacements and entry to the junction box and is beyond the control of the designer. As such, accommodating maintenance activity requires virtually foolproof means of reassembly to maintain the sealed integrity of the overall system and the components thereof.

Versatility of application with longevity and repeatable maintenance has long remained a design challenge. Typically components are stacked vertically in in-grade fixtures. This provides easy access through the lens opening for maintenance. Reference is made to the foregoing teachings incorporated herein by reference. With this convention, however, versatility of application is compromised where a relatively deep installation is inappropriate. This is particularly true of the junction box where the wiring is relatively fixed. Components such as lamps, emitters, ballasts and electronic controls can be accessed and even pulled from the housing through the lens opening, given modular construction and ample leads. Rewiring, however, typically requires reentry into the junction box.

SUMMARY OF THE INVENTION

The present invention is directed to sealed in-grade fixture design providing versatile lamp profiles with adequate provision for maintenance and other features. In a separate invention, counterintuitive thermal flow is created to enhance longevity of light generating components. The lighting system includes a sealable housing with a top wall, a bottom wall, a lens seat in the top wall defining a lens opening, a cavity, a junction box between the top and bottom walls and a partition wall bifurcating the housing between the cavity and the junction box.

In a first separate aspect of the present invention, an LED power control is presented within the lamp cavity. An LED board array is positioned directly beneath the lens opening. A radiator is in the lamp cavity directly below the LED board array. The radiator is constructed and arranged to radiate to directly beneath the second closed portion of the top wall. The radiated heat could then pass through the substantially greater housing surfaces, the extent of which being dictated by the presence of the LED power control, laterally of the lens opening.

In a second separate aspect of the present invention, an LED power control is presented within the lamp cavity. An LED board array is positioned directly beneath the lens opening. A heat sink is arranged beneath the board array which includes a plate coextensive and in thermal contact with the board array. The heat sink further includes a thermal block depending from the plate and in thermal conductivity with a radiator having radially extending fins. This radiator is in the lamp cavity directly below the LED board array. The radiator is constructed and arranged to radiate to directly beneath the second closed portion of the top wall. In a closed housing, heat tends to stratify through convection adjacent the lens in an in-grade fixture. Through the heat sink and the radiator, heat is conducted down and then radiated outwardly in a nonintuitive inversion. The radiated heat could then pass through the substantially greater housing surfaces, the extent of which being dictated by the presence of the LED power control, laterally of and below the lens opening.

In a third separate aspect of the present invention, any of the foregoing separate aspects are contemplated to be employed in combination to greater advantage.

Accordingly, it is a principal object of the present invention to provide an improved sealed in-grade LED light fixture. Other and further objects and advantages will appear hereinafter.

DETAILED DESCRIPTION OF THE PREFERRED EMBODIMENTS

Figure 1:
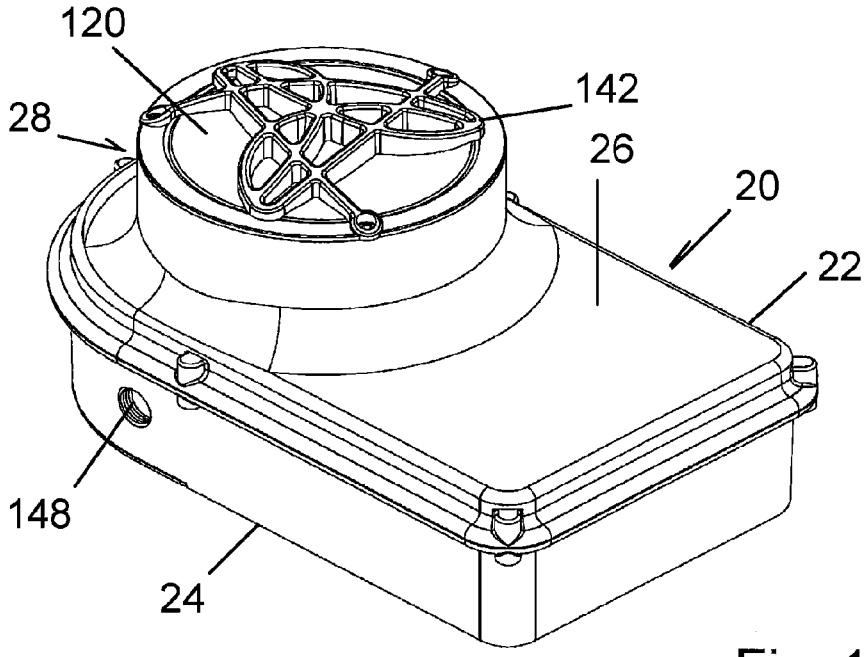
FIG. 1 is a perspective view of an assembled in-grade fixture.

Turning to FIGS. 1 through 7, a conventional light source is associated with a low profile fixture. A housing, generally designated 20, is principally fabricated from three body parts which are molded and define a top body portion 22, a closure plate 52, and a bottom body portion 24. These portions 22, 24, and 52 meet at tongue and groove joints which are bonded to fully seal the joint and retain the housing 20 together as an integral unit. As the joint is about the waist of the housing 20, the top and bottom body portions 22, 24 join together to form peripheral sides of the housing 20.

The top body portion 22 extends to form a top wall 26. This top body portion 22 further defines a lens seat, generally designated 28, which extends upwardly and defines a lens opening 30. An outer cylindrical body 32 creates the lens seat 28 in its extension upwardly from the top wall 26. The outer cylindrical body 32 includes an annular mounting shelf 34 that is inwardly of an upper edge 36. A cylindrical sealing flange 38 extends upwardly as well. A cylindrical passageway 40 extends downwardly from the cylindrical sealing flange 38 to an annular retaining flange 42. The annular mounting shelf 34 further includes three holes 44 equiangularly spaced about the outer cylindrical body 32 with threaded inserts 46 therein to receive fasteners for retaining a lens.

The bottom body portion 24 and the closure plate 52 assembled therewith define a bottom wall 48. An access hole 50, principally below a junction box that is defined within the housing 20, is closed by the closure plate 52. A plurality of fasteners 54 physically retain the closure plate 52 in a sealed relationship with the access hole 50 in further defining the bottom wall 48. The closure plate 52 is preferably bonded to the bottom wall 48. The fasteners 54 extend into predrilled holes 56 from the closure plate 52 into the bottom body portion 24. A tongue and groove peripheral joint between the closure plate 52 and the bottom body portion 24 enhances sealing and placement. The access hole 50 is convenient for molding the bottom body portion 24 and for placement of a grommet, described below, before bonding in place.

Figure 2:
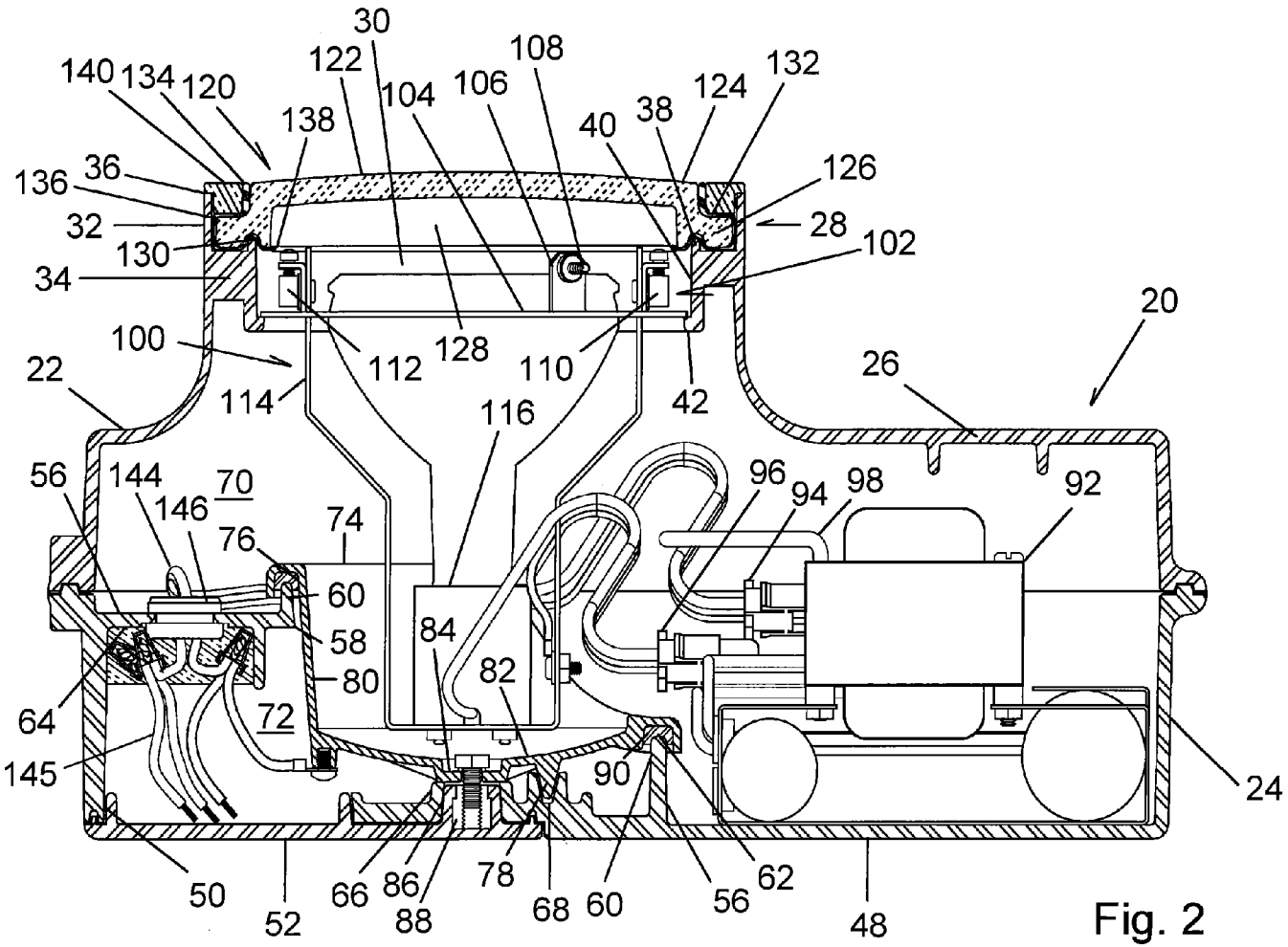
FIG. 2 is a cross-sectional side view of the in-grade fixture taken through a centerline of the housing.

Between the bottom wall 48 and the top wall 26 and integrally formed as part of the bottom body portion 24, a partition wall 56 terminates in a closure seat 58. The closure seat includes a vertically extending seating flange 60 defining the periphery of an access port 62. The vertical extension of the seating flange 60 is presented to allow the closure seat 58 to receive a vertically introduced closure. In spite of the vertical orientation of the seating flange 60, the closure seat 58 does not terminate in a plane, as can be seen in FIG. 2. A potting cavity 64 is defined on one side of the partition wall 56 which, in the final orientation, opens downwardly. The partition wall 56 with the closure seat 58 in the bottom body portion 24 is above the hole 50 which is sealed with closure plate 52 to define a junction box cavity.

Also integral with the bottom body portion 24, a seating hub 66 extends to directly beneath the lens opening 30 to form a mounting hub with a hole there through for a fastener. A keyway 68 is found on the inner surface of the bottom body portion 24 as well.

With the housing portions 22, 24, 52 assembled, a sealed lamp cavity 70 and a junction box cavity 72 are created with the partition wall 56 bifurcating the housing cavity to form these two volumes. The cavities 70, 72 are sealed from the outside with a lens closing the lens opening 30 and from each other through a closure 74. The access port 62 defined in the partition wall 56 and bounded by the closure seat 58 extends between two levels in the housing 20. In doing so, the access port 62 provides an opening for lateral access from beneath the lens opening 30 toward the periphery of the housing 20. Thus, the access port 62 faces the lamp cavity 70 defined within the housing 20.

The access port 62 is closed by the closure 74. The closure 74 includes a peripheral channel 76 receiving the closure seat 58 to mate with the vertically extending sealing flange 60. A first portion of the channel is found at a lower level, a second portion of the channel is found at an upper level and two portions of the channel extend between the lower and upper levels. Because the closure seat 58 includes a vertically extending sealing flange 60, the peripheral channel 76 engages the flange 60 by moving vertically from the lens opening 30. As the access port 62 is directly below the lens opening 30, placement of the closure 74 is facilely completed. Additionally, a key 78 fits into the keyway 68 to insure proper orientation.

The closure 74, inwardly of the peripheral channel 76, includes a truncated conical wall 80 cut away to create the peripheral profile discussed. Additionally, the closure 74 includes a plate 82 that extends across the bottom wall 48. The plate 82 is dished to form a segment of a sphere with a surface generating radius having a center of curvature near a point about which the light source is mounted to pivot to give clearance to the assembly of the light source. The plate 82 has a hole 84 there through concentrically positioned and receiving a fastener. The junction box 72, which is laterally displaced from below the lens opening 30, is fully accessible through the lens opening 30 with the lens removed and with vertical removal of the closure 74. A boss 86 with a threaded insert 88 is located in the closure plate 52 to receive the fastener and O-ring positioned through the hole 84 in the plate 82. The seating hub 66 is between the boss 86 and the plate 82 such that the fastener is able to draw these components together to firmly seal the peripheral channel 76 on the vertically extending sealing flange 60 with the help of a gasket 90.

The lamp cavity 70 extends laterally in a volume sufficient to hold a conventional ballast assembly. This volume provides increased cooling without requiring further housing depth. A ballast assembly 92 is positioned within the lamp cavity 70 extending laterally from beneath the lens opening 30 when the light source requires same. The ballast assembly 92 can be easily extracted from the lens opening 30 for repair or maintenance. The ballast assembly also has quick disconnect connectors 94, 96 to facilitate removal as well as a handle 98 with which to withdraw the ballast assembly 92 from the lamp cavity 70.

Figure 3:
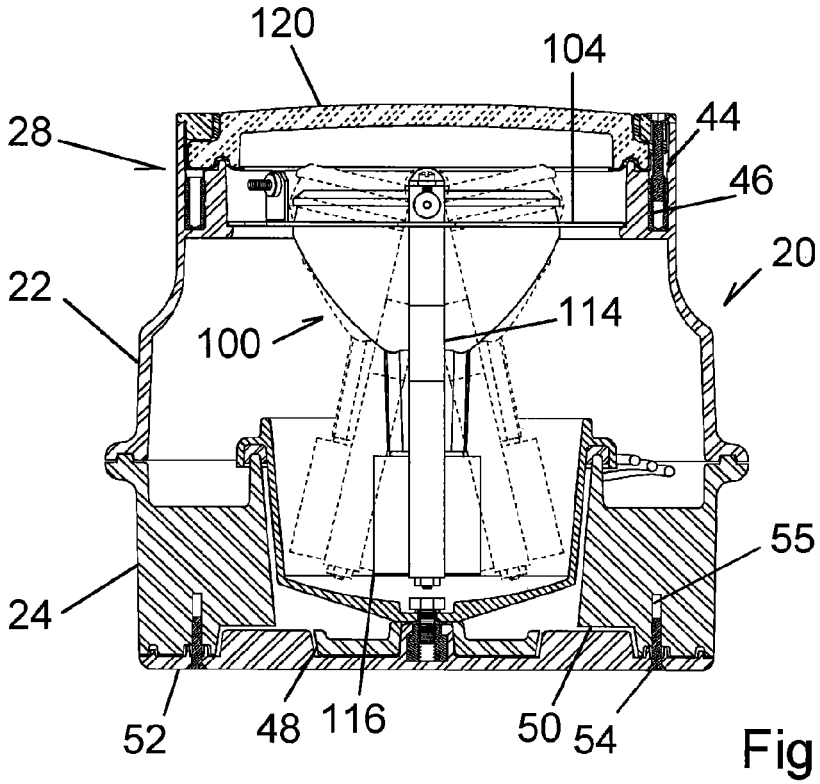
FIG. 3 is a cross-sectional end view of the in-grade fixture looking toward the junction box from the centerline of the fastener and the closure.
Figure 4:
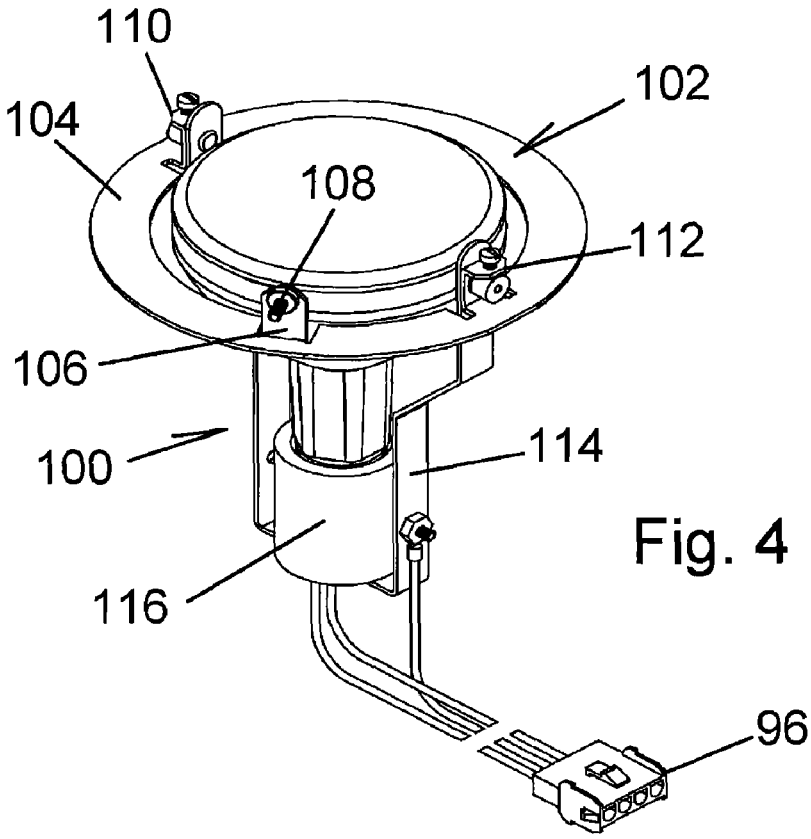
FIG. 4 is a perspective view of a socket assembly for a conventional reflectorized lamp.
Figure 5:
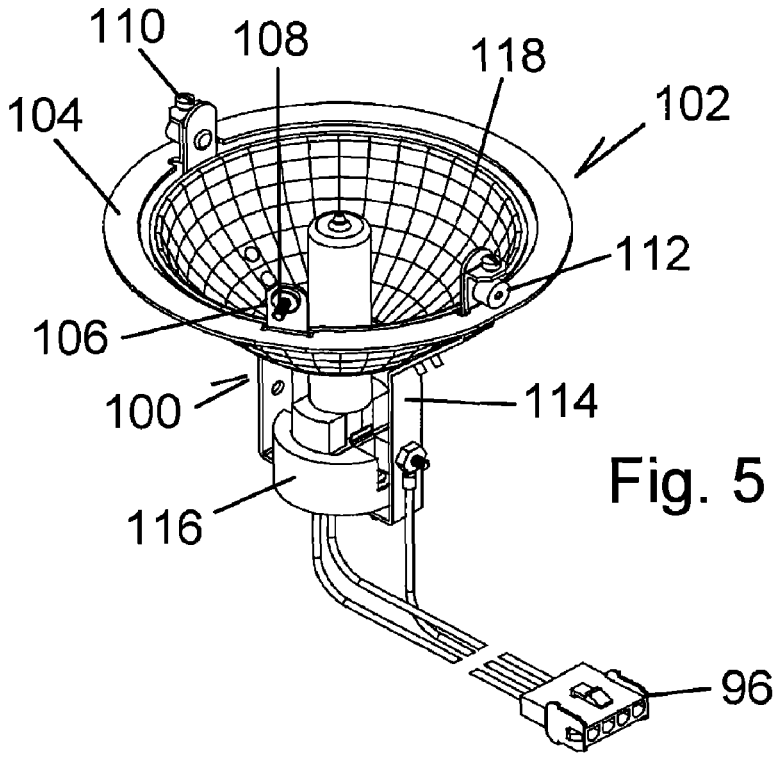
FIG. 5 is a perspective view of a light source having a separate reflector defining a socket assembly.
Figure 6:
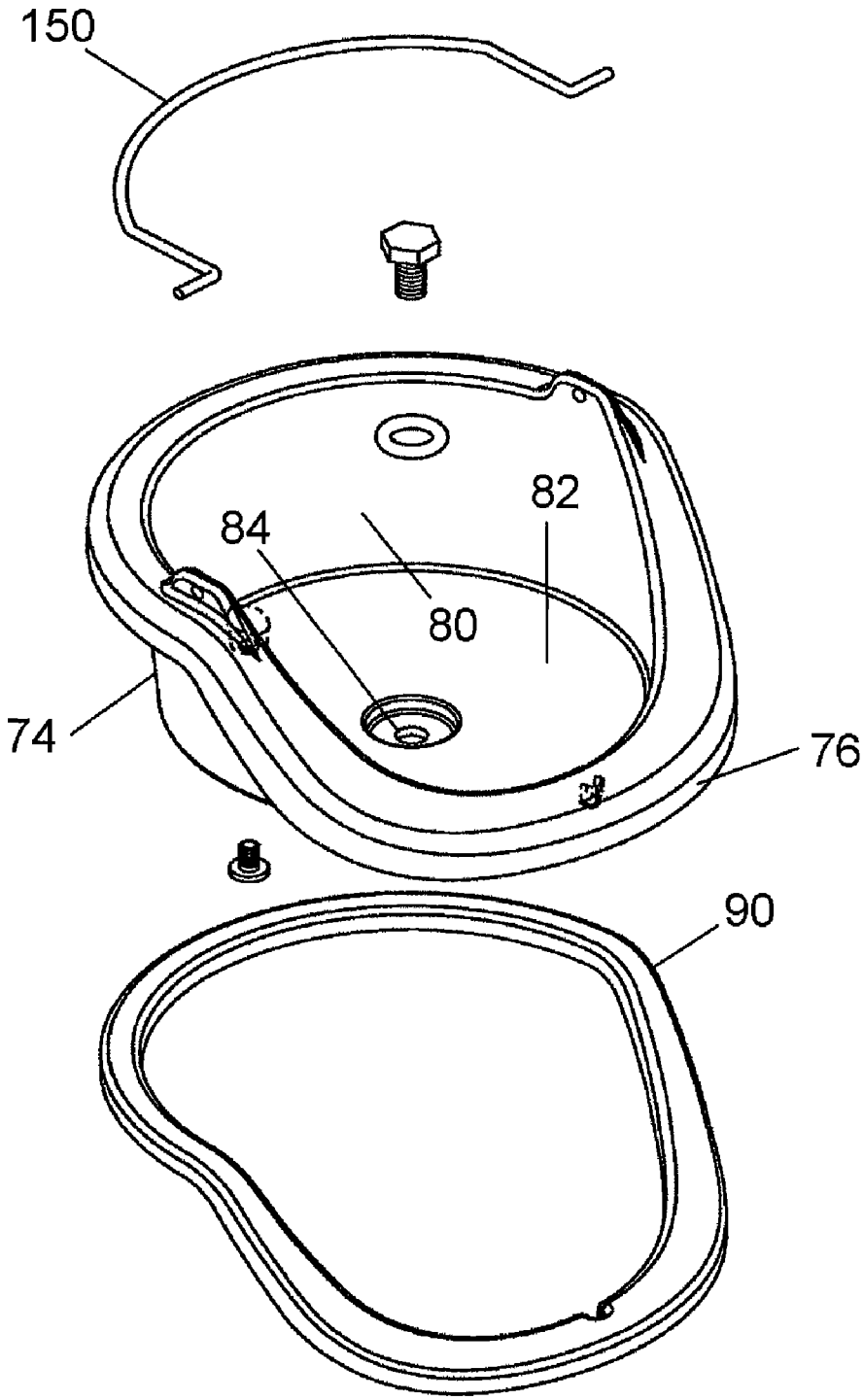
FIG. 6 is an exploded perspective view of a closure.
Figure 7:
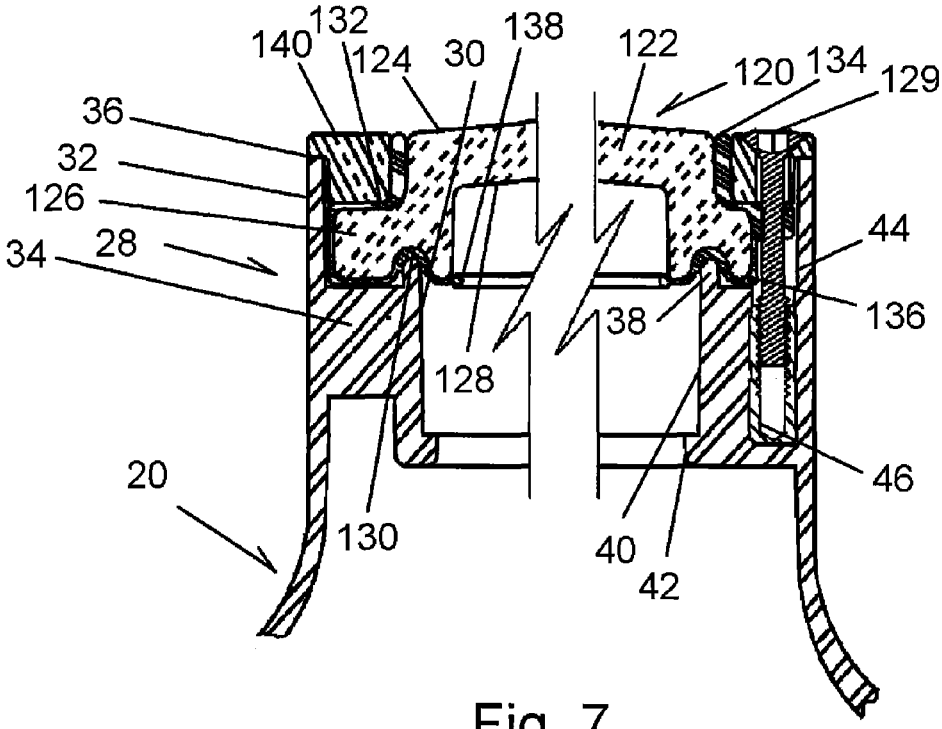
FIG. 7 is a cross-sectional detail of the lens and lens seat.

A socket assembly, generally designated 100, is illustrated in place in FIGS. 2 and 3 and separately in FIGS. 4 and 5. The socket assembly 100 is illustrated in two embodiments, one with a reflectorized lamp and the other with a non-reflectorized lamp which requires the inclusion of a separate reflector. The difference does not impact the present concepts. The socket assembly 100 depends from adjacent the lens seat 28. The assembly includes a mount, generally designated 102, which includes a mounting ring 104 that sits upon the annular retaining flange 42 in the cylindrical passageway 40 associated with the lens seat 28.

The mounting ring 104 includes three upstanding mounts. A first mount 106 receives and threadably engages a screw 108 which extends radially outwardly. This screw 108 can be extended to engage the lens seat 28 within the cylindrical passageway 40 to prevent rotation of the mounting ring 104. Conversely, the screw 108 can be loosened so that the mounting ring 104 can be rotated about a vertical axis. The second and third mounts 110, 112 are diametrically opposed from one another and provide a common axis for pivotal motion about the mounting ring 104.

The socket assembly 100 further includes a depending mounting strap 114 which is pivotally mounted to the pivot mounts 110, 112 and extends down to mount a lamp socket 116 aligned with the lens opening 30. The socket 116 is in electrical communication with the ballast assembly 92 through the connector 96. The mounting strap 114 is also grounded through the connector 96. In FIG. 5, a reflector 118 is affixed to the mounting strap 114 where the light source does not employ a reflectorized lamp.

FIG. 3 illustrates in dashed lines the adjustment possible with rotation about the mounts 110, 112. By also rotating the mounting ring 104, a range of universal angular adjustments can be made for directing the light from the lamp. This adjustment is sufficient to allow a selection within the useful angular range of the lens opening as further tilting of the socket assembly 100 is limited by the truncated conical wall 80 of the closure 74 which prevents the socket assembly 100 from direct light beyond the lens 120 opening in light shining on the interior of the lamp rather than through the lens.

Figure 11:
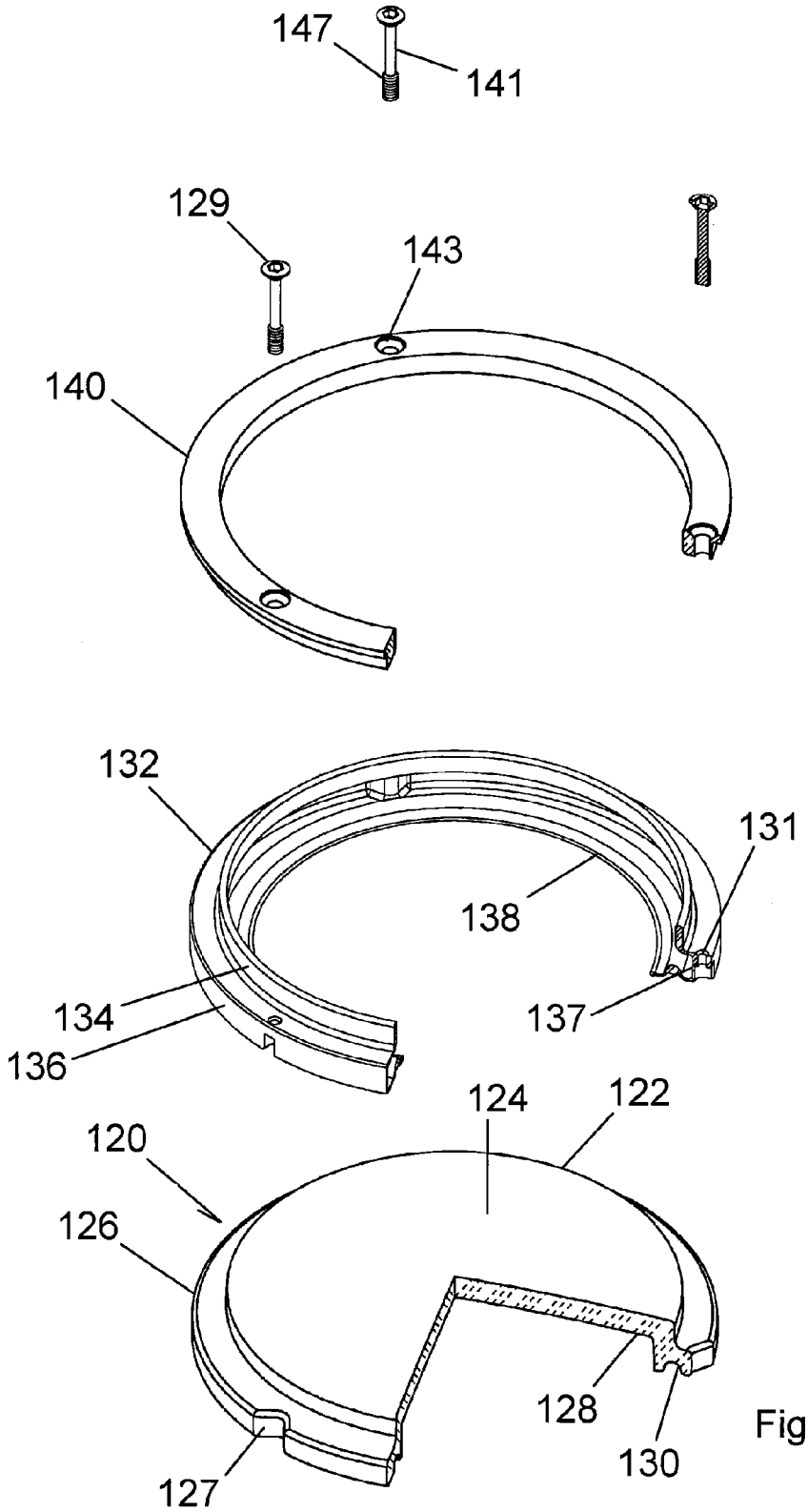
FIG. 11 is an exploded perspective view of a lens, gasket and locking ring.

A lens, generally designated 120, includes a sight glass 122 having an outer surface 124 through which light is to pass. The outer surface may have a raised textured pattern thereon to avoid slipping. A mounting flange 126 extends about the periphery of the sight glass 122 and is displaced axially from the outer surface 124. A cavity 128 inwardly of the mounting flange 126 is adjacent the sight glass 122. A sealing groove 130 is about the underside of the mounting flange 126. The mounting flange 126 contains notches 127, as seen in FIG. 11, inwardly of peripheral diameter, which allows fasteners 129 to be positioned inwardly of the peripheral diameter. These notches 127 allow for the sight glass 122 to be of maximum diameter for the passage of light while minimizing the outer cylindrical body 32 diameter. The lens 120 is positioned in the lens seat 28 within the outer cylindrical body 32 on the annular mounting shelf 34. The cylindrical sealing flange 38 extends into the sealing groove 130.

A formed gasket 132 is positioned about the mounting flange 126. A first portion 134 is cylindrical to surround the sight glass 122. Below the cylindrical portion 134, a three-sided portion 136 extends across the upper, lower and peripheral sides of the mounting flange 126. The gasket 132 has keyed inward molded protrusions 137 that partially fill the notches 127 of the mounting flange 126. Through these molded protrusions 137 are molded through holes 131 of such a diameter as to capture the fasteners 129 and hold them in position. The gasket 132 then continues inwardly to extend between the cylindrical sealing flange 38 on the lens seat 28 and the sealing groove 130 on the lens 120. This culminates in an inwardly extending portion 138 which intrudes into lower portion of the cavity 128. This intrusion allows capture of wafer-shaped optics which fit within the cavity 128 such as filters and colored lenses.

A locking ring 140 retains the lens 120 in place. The fasteners 129 threaded into the inserts 46 in the annular mounting shelf 34 hold the locking ring 140 in place. The locking ring 140 engages the upper edge 36 of the outer cylindrical body 32 to restrict its travel regardless of the torque placed on the retaining fasteners. This prevents the mounting flange 126 from being tightened to damage the gasket 132 placed in interference fit between the cylindrical sealing flange 38 and the sealing groove 130, yet the axial distance between the edge 36 and the sealing flange 38 can allow the formed gasket 132 to be brought into compression for sealing between the cylindrical sealing flange 38 and the sealing groove 130. The cylindrical portion 134 of the formed gasket 132 may be sized to fill the gap between the sight glass 122 and the locking ring 140. In addition to the locking ring 140, a rock guard 142 (as seen in FIG. 1) may be employed over the lens 120 and fastened in association with the locking ring 140. Reference is made to U.S. Design application Ser. No. 29/296,394, filed Oct. 19, 2007.

The locking ring 140 has axial countersunk holes 143 there through to align the locking ring 140 with the holes 131. The fasteners 129 each include a smooth shank 141 and an enlarged threaded end 147 to capture the molded protrusions 137 through avoiding facile withdrawal of the fasteners 129 through the axial through holes 131. This can keep the lens assembly, including the lens 120, the gasket 132, the locking ring 140 and the fasteners 129 together for easy reassembly with the housing 20.

Electrical wires 144 extend through a grommet 146 located in the partition wall 56. The wiring 144 extends from the grommet into the lamp cavity 70 to the connector 94 for coupling with the ballast assembly 92 or the socket assembly 100. The wiring 144 extends from the grommet into the junction box cavity 72 and into the potting cavity 64. In the potting cavity 64, the wiring 144 is spliced to electrical supply leads 145 in such a manner as to form a waterproof wicking barrier. This waterproof wicking barrier is created by individually soldering the ends of the both the electrical supply leads 145 and the ends of the wires 144, then crimping them together such that potting material poured into potting cavity 64 forms an intimate bond on the solidified wires surfaces, preventing water from passing through the potting material. The electrical leads 145 emerging from the potting material into the junction box cavity 72 are employed for making the appropriate connections to electrical supply wiring.

The closure plate 52 has molded threaded holes 148 for receiving electrical supply wiring for connection to the electrical leads 145. The holes 148 are configured for standardized conduit. As the electrical supply wiring is solid wire rather than stranded and is typically pulled in through conduit after the fixture installation using a fish tape or other apparatus, the holes are arranged and positioned such that there need be very little bending of the wire as it is pulled into the junction box by apparatus introduced to the supply conduit though the access port 62 and the junction box 72. The access port 62 is designed in contemplation of the difficulty with handling solid wire for installation or renewal. It is anticipated that moisture will ultimately be introduced through the conduit or supply wiring into the junction box 72. The partition wall 56, grommet 146 and closure 74 define a moisture proof barrier to keep the lamp cavity 70 dry.

In operation, the housing 20 is presented at the placement site. The electrical leads 145 emerging from the potting material are connected to the electrical supply wiring from power supplied to the site. This electrical supply wiring is positioned through one or more threaded holes 148 located about the sidewall of the bottom body portion 24 or from the bottom threaded hubs of the closure plate 52. Connections are made with appropriate splicing nuts and are made through the access port 62. Once complete, the spliced wiring is facile positioned entirely into the junction box cavity 72, and this junction box cavity 72 is sealed from the lamp cavity 70 with closure 74 using a single fastener and O-ring. The junction box may potentially be subjected to moisture without substantial harm.

In instances where socket assemblies 100 require the use of ballast assemblies 92 to properly operate the lamp, the ballast assembly 92 is positioned laterally of the lens opening 30 within the housing 20, and the wiring 144 is connected to ballast connector 94. The socket assembly 100 is lowered into the lens opening 30 and connector 96 is connected to ballast assembly 92. The socket assembly 100 is then fully lowered in place, supported by the mounting ring 104 on the annular retaining flange 42. Where lamp types that operate directly on incoming electrical power without the need for ballasts, the connector 94 couples directly to lamp connectors 96. Differences in the quantity and shapes of connectors 92, 94, and 96 determine the connection coupling pairings. The direction of light may then be achieved by manipulating the mount 102 and locking the orientation in place. Finally, the lens 120 is positioned within the gasket 132 thereabout in the lens seat 28. The locking ring 140 is then affixed.

For maintenance, the lens 120 is removed followed by the socket assembly 100. Relamping can then occur. If further operations are required to repair or replace the ballast assembly 92, this can be withdrawn through the lens opening 30. Finally, if rewiring is necessary, the closure 74 may be withdrawn from the housing 20. The fastener at the center of the closure plate 82 is withdrawn and the wire handle 150 may be grasped to pull the closure 74 from the housing 20. With the closure 74 removed, the re-wiring of the fixture can be addressed through the lens opening 30 without requiring removal of the housing 20 from its in-grade position. The gasket 90 may be replaced and the process reversed for assembly.

Figure 9:
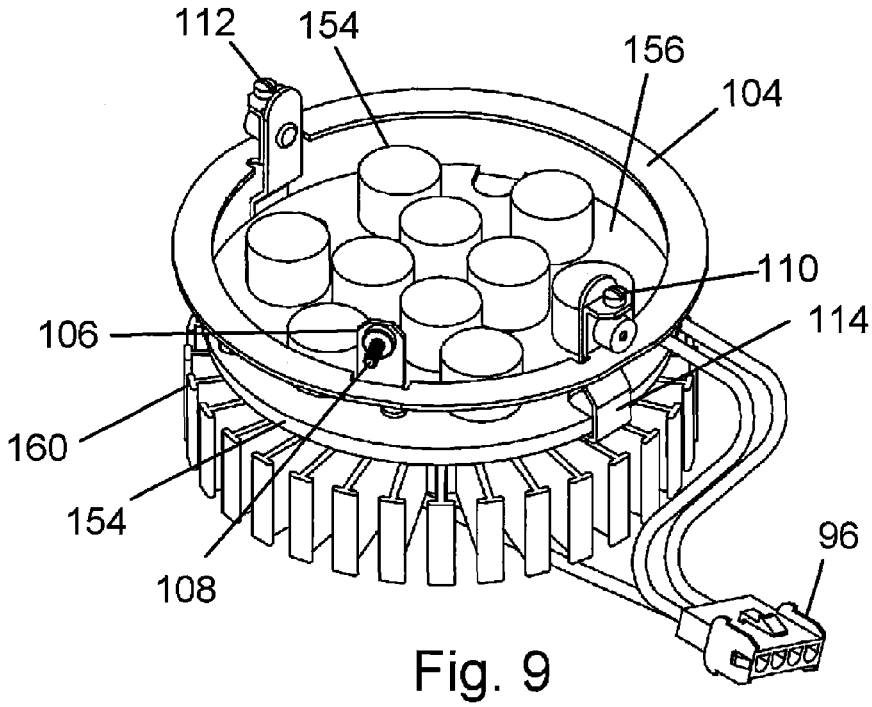
FIG. 9 is a perspective view of an assembled LED board array with radiator.
Figure 8:
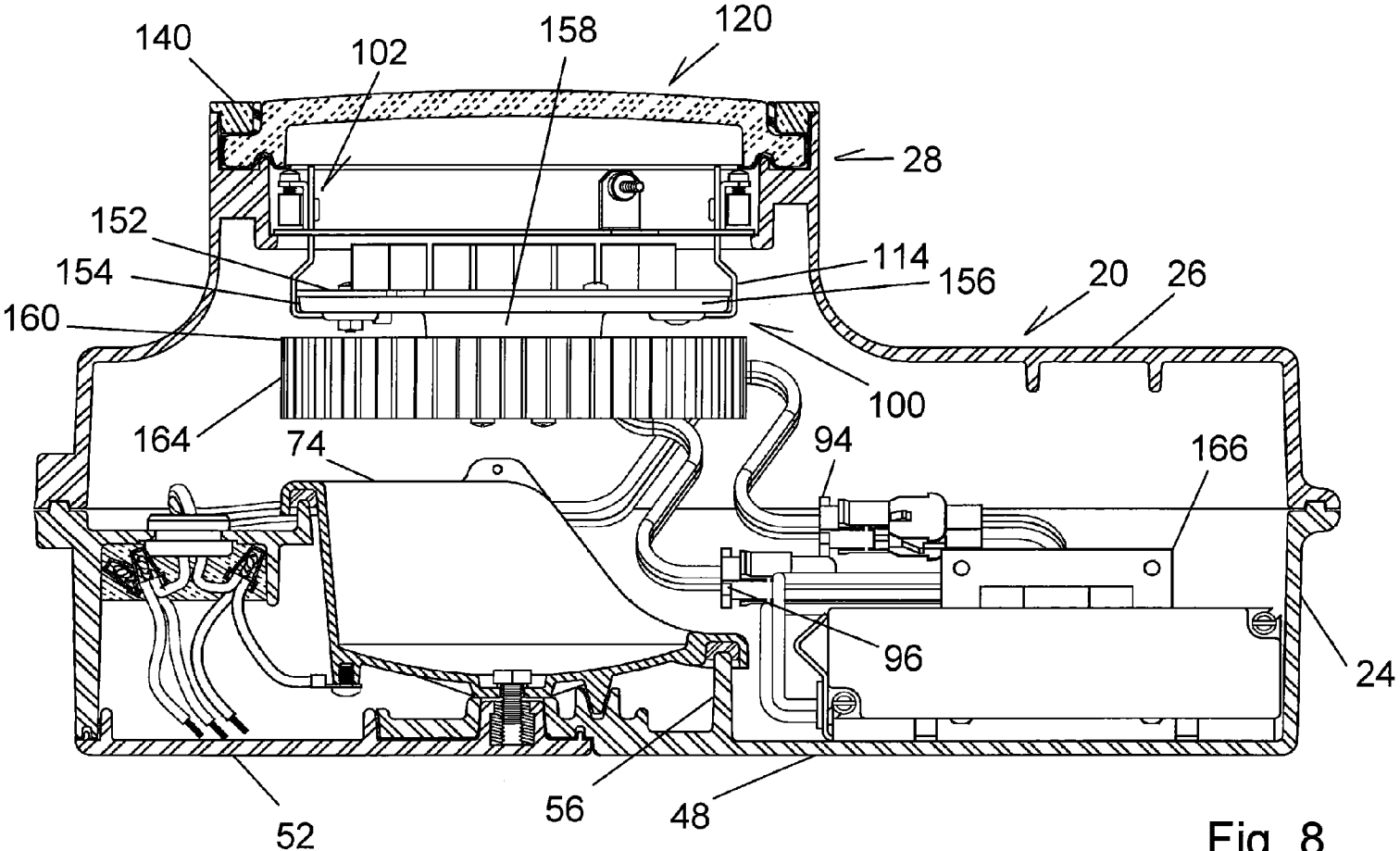
FIG. 8 is a cross-sectional side view taken through the centerline of the housing with an LED board array.
Figure 10:
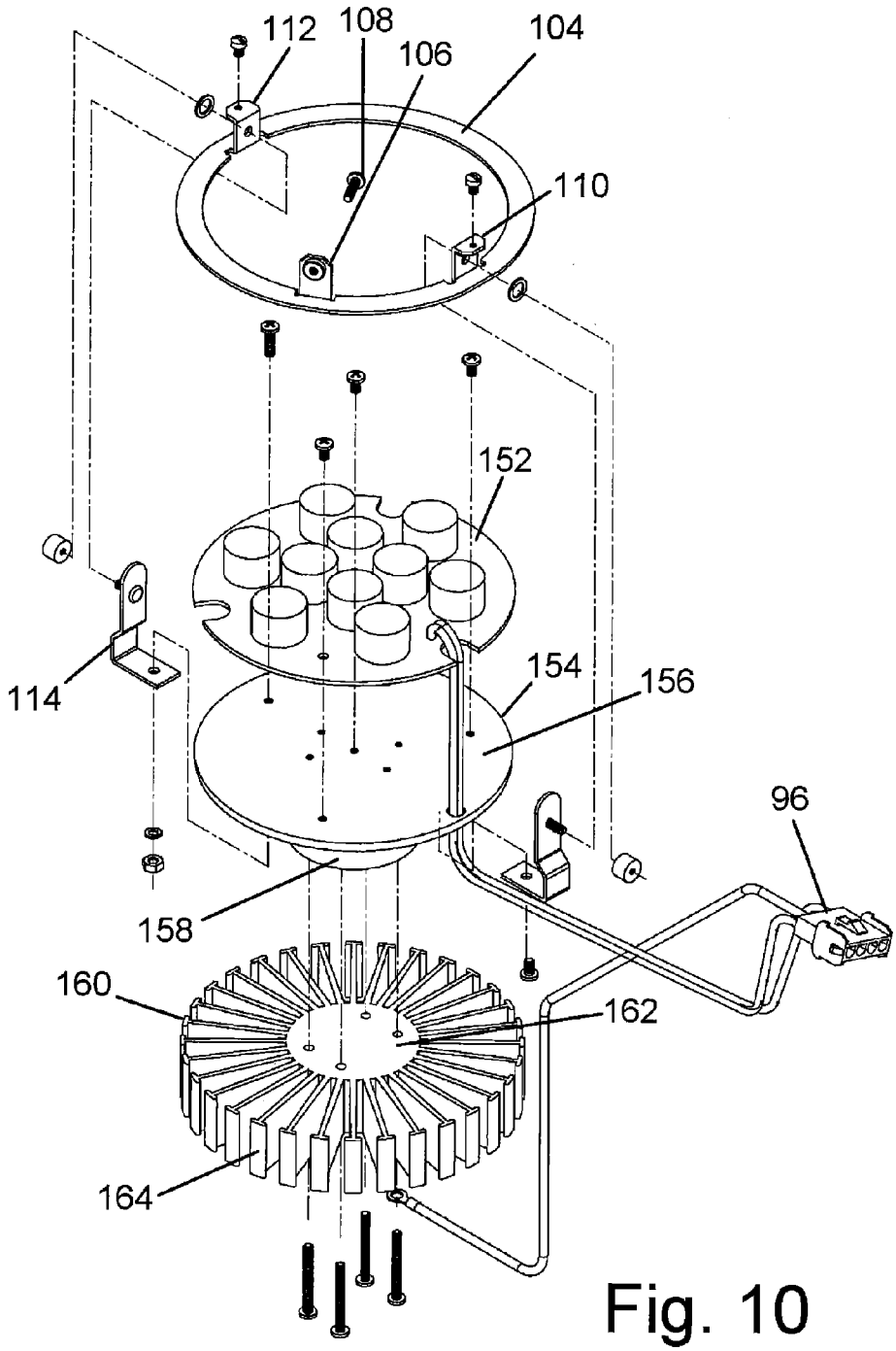
FIG. 10 is an exploded perspective view of the assembly for an LED board array and radiator.

Turning next to FIGS. 8 through 10, a fixture employing an LED array is illustrated. Common elements between embodiments employ identical reference numbering for brevity. The mount 102 supports mounting straps 114 much as in the prior embodiment. These mounting straps 114 mount an LED circuit board array 152. Such circuit board arrays 152 are commonly mounted on metal heat transfer materials.

The array 152 is securely bolted for maximum thermal conductivity to a heat sink 154. The heat sink 154 is of high heat transfer metal. The heat sink 154 includes a plate 156 which is coextensive with the LED circuit board array 152. Further, the heat sink 154 includes a thermal block 158 depending from the plate 156. A molded radiator 160 is also of thermally conductive material and includes a central block 162 in thermal conductivity with the thermal block 158. Integral fins 164 extend radially outwardly from the central block 162. Fasteners may retain this assembly together. Viewing the assembly in FIG. 8, the radiator 160 is shown to be located in the main body of the lamp cavity 70. Rather than heat traveling upwardly from convection, heat moves rapidly by conduction to the radiator 160 in a downwardly direction for radiation into the larger cavity of the lamp housing 20. This larger cavity is better able to dissipate heat from the LED array 152 than the area above the array 152 and below the lens 120. An LED power control 166 takes the place of the ballast assembly 92 of the prior embodiment. The power control 166 is positioned laterally from beneath the lens opening 30 in the lamp cavity 70. Assembly and maintenance procedures are near identical between embodiments.

Thus, a sealed in-grade fixture of improved performance and adaptability is disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A lighting system comprising a sealable housing including a bottom wall, a top wall having a first portion with a lens seat extending upwardly from the top wall to define a lens opening and a closed second portion extending laterally from the lens seat, a cavity between the top wall and the bottom wall extending beneath the first and second portions of the top wall;

a light emitting diode power control in the cavity, the second portion of the top wall extending fully above the light emitting diode power control;

a light emitting diode array directly beneath the lens opening;

a radiator in the cavity directly beneath the array and in thermal contact with the light emitting diode array, the radiator being constructed and arranged to radiate through the cavity to directly beneath the second portion of the top wall.

2. The lighting system of claim 1, wherein the sealable housing further includes a junction box between the cavity and the bottom wall and having a port accessible into the junction box directly below the lens opening

3. The lighting system of claim 1 further comprising a heat sink directly beneath the array constructed and arranged to provide thermal contact between the array above and the radiator below and including a plate and a thermal block depending from the plate in thermal contact with the plate, the radiator is around and in thermal contact with the thermal block and the radiator includes fins, the heat sink, radiator and light emitting diode array are in the cavity.

4. The lighting system of claim 3, wherein the heat sink and the radiator are separately formed.

* * * * *